US008156903B2

(12) United States Patent
Guala et al.

(10) Patent No.: US 8,156,903 B2
(45) Date of Patent: Apr. 17, 2012

(54) ACTUATING DEVICE OF A RECIRCULATION PUMP FOR A COOLING CIRCUIT OF AN INTERNAL COMBUSTION ENGINE

(75) Inventors: Andrea Guala, Biella (IT); Gianluca Cariccia, Romano Canavese (IT); Riccardo Seren Rosso, Busano (IT)

(73) Assignee: Dayco Europe S.r.l. con Unico Socio, Chieti (IT)

( * ) Notice: Subject to any disclaimer, the term of this patent is extended or adjusted under 35 U.S.C. 154(b) by 1189 days.

(21) Appl. No.: 11/791,368

(22) PCT Filed: Aug. 29, 2005

(86) PCT No.: PCT/EP2005/054247

§ 371 (c)(1), (2), (4) Date: Nov. 14, 2007

(87) PCT Pub. No.: WO2006/056494

PCT Pub. Date: Jun. 1, 2006

(65) Prior Publication Data

US 2008/0184945 A1 Aug. 7, 2008

(30) Foreign Application Priority Data

Nov. 23, 2004 (IT) ..... TO2004A0824

(51) Int. Cl.
*F01P 5/10* (2006.01)

(52) U.S. Cl. ..... 123/41.44; 123/41.02; 123/41.19; 123/41.01

(58) Field of Classification Search ..... 123/41.44, 123/41.02, 41.19, 41.01
See application file for complete search history.

(56) References Cited

U.S. PATENT DOCUMENTS

| | | | | |
|---|---|---|---|---|
| 4,408,953 | A * | 10/1983 | Nasvytis et al. | 415/62 |
| 5,076,216 | A * | 12/1991 | Ro | 123/41.46 |
| 5,791,558 | A * | 8/1998 | Hoshino et al. | 237/12.3 B |
| 6,915,887 | B2 * | 7/2005 | Faller et al. | 192/48.2 |

FOREIGN PATENT DOCUMENTS

| | | |
|---|---|---|
| DE | 10013252 | 10/2001 |
| DE | 10131792 | 10/2002 |
| DE | 10232138 | 1/2004 |

(Continued)

OTHER PUBLICATIONS

International Preliminary Report on Patentability in PCT Appln. No. PCT/EP2005/0054247, dated May 30, 2007 [5 pages].
International Search Report in PCT Appln. No. PCT/EP2005/0054247, dated Nov. 10, 2005 [3 pages].

(Continued)

*Primary Examiner* — Noah Kamen
*Assistant Examiner* — Long T Tran
(74) *Attorney, Agent, or Firm* — Davidson, Berquist, Jackson & Gowdey, LLP

(57) ABSTRACT

Actuating device for a recirculation pump of a cooling circuit of an internal combustion engine comprising a pulley suitable for being rotationally driven by the engine, a driven shaft for driving the pump and an electromagnetically controlled coupling interposed between the pulley and the driven shaft, in which the electromagnetic coupling comprises an electromagnet, coupling mechanism controlled by the electromagnet and mobile between an engagement position in which the pulley is connected to the driven shaft and a disengagement position, and an elastic member for maintained an engagement member in the engaged position when the electromagnet is not energized.

20 Claims, 5 Drawing Sheets

FOREIGN PATENT DOCUMENTS

| | | |
|---|---|---|
| EP | 1353051 | 10/2003 |
| GB | 2391048 | 1/2004 |
| JP | 2004293430 | 10/2004 |
| WO | WO 2004/007923 | 1/2004 |

OTHER PUBLICATIONS

International Written Opinion in PCT Appln. No. PCT/EP2005/0054247, dated Nov. 8, 2005 [4 pages].
JP Appln. No. 2007-541888 Dec. 17, 2010 JPO Office Action.

* cited by examiner

ACTUATING DEVICE OF A RECIRCULATION PUMP FOR A COOLING CIRCUIT OF AN INTERNAL COMBUSTION ENGINE

This application is the National Phase of International Application PCT/EP2005/054247 filed Aug. 29, 2005 which designated the U.S. and that International Application was published under PCT Article 21(2) in English.

TECHNICAL FIELD

The present invention relates to an actuating device of a recirculation pump for a cooling circuit of an internal combustion engine.

BACKGROUND ART

As it is known, internal combustion engines are equipped with a cooling circuit in which a pump driven by the crankshaft circulates a coolant fluid adapted to subtract heat from the engine, in use, to maintain the temperature of the engine components within an acceptable range of values. According to a conventional solution, the pump is permanently driven by the crankshaft, via a belt transmission, and therefore cannot be deactivated.

In motor vehicles, there is the problem of letting the engine reach a warmed-up condition as rapidly as possible after start up, for the two-fold purpose of reducing polluting emissions and allowing the engine to rapidly reach maximum efficiency.

For this purpose, there have recently been proposed actuating devices of the coolant fluid recirculation pump adapted to deactivate the pump at engine ignition until such warmed-up condition is reached.

A known solution consists in driving the pump by a first friction wheel that takes motion from the crankshaft and drives by rolling friction a second friction wheel fitted on the pump shaft. The first friction wheel is controlled by an actuator so that it can be disconnected from the second friction wheel.

However, the described device is somewhat complex, cumbersome and costly. In particular, it is quite difficult to provide a friction wheel device that allows to maintain the recirculation pump activated in the event of a failure to the electrical system or to the actuator, and therefore ensure engine operation.

DISCLOSURE OF INVENTION

The object of the present invention is to provide an actuating device of a recirculation pump for an internal combustion engine which solves the aforesaid problems associated with the known devices.

Said object is achieved by a device according to claim 1.

BRIEF DESCRIPTION OF THE DRAWINGS

For a better understanding of the present invention, several preferred embodiments will now be described, by way of non-limitative examples only and with reference to the accompanying drawings, in which.

BEST MODE FOR CARRYING OUT THE INVENTION

Figure 1:
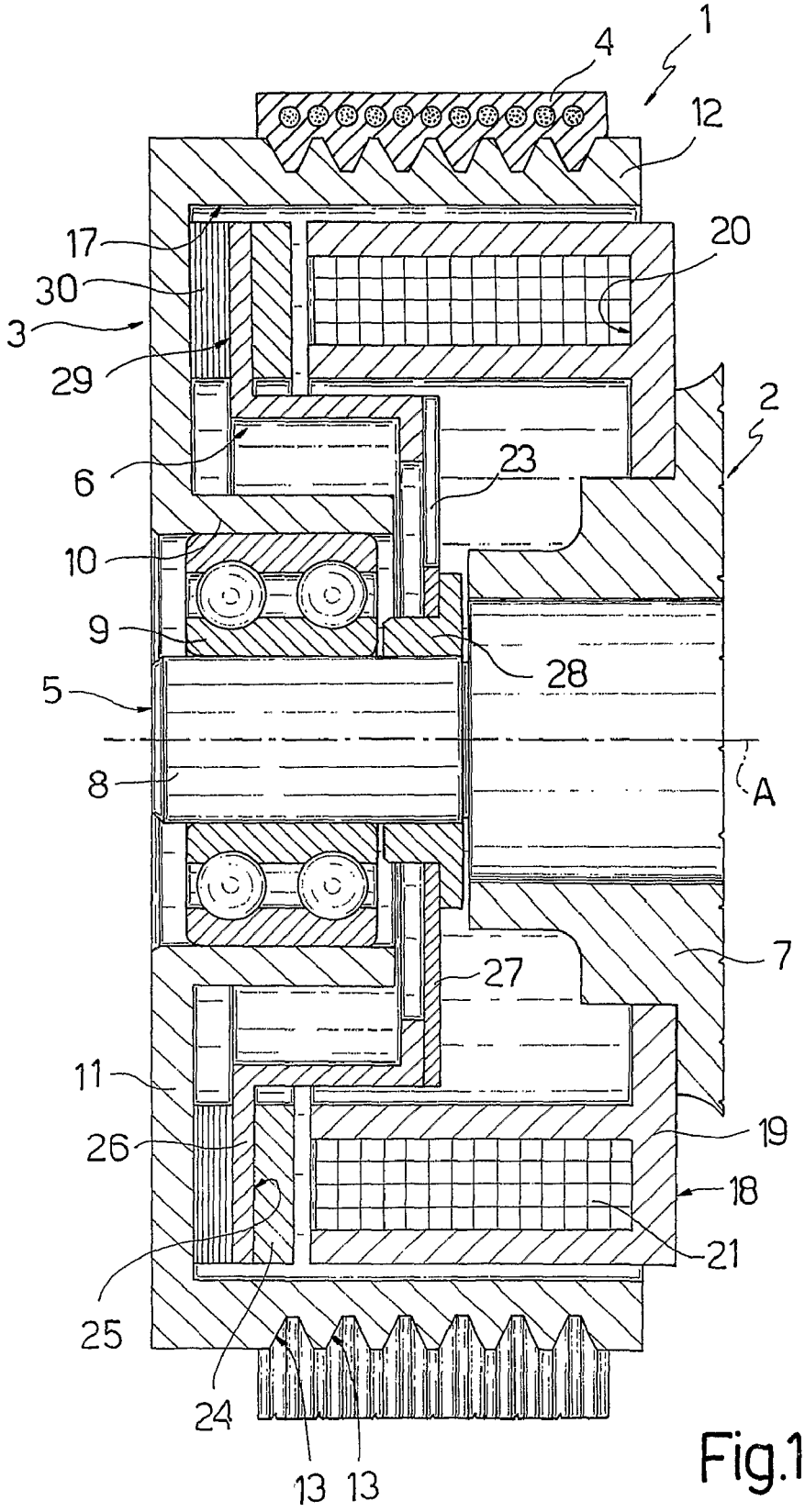
FIG. 1 is an axial section of a first embodiment of a recirculation pump actuating device according to the present invention.

With reference to FIG. 1, numeral 1 indicates as a whole an actuating device of a recirculation pump 2 (partially shown) for a cooling circuit of an internal combustion engine.

The device 1 comprises essentially a pulley 3 adapted to be connected to the crankshaft (not shown) of the engine via a transmission belt 4 and constituting a driving member, a driven member constituted by the input shaft 5 of the pump 2, and an electromagnetically operated coupling 6 interposed between the pulley 3 and the shaft 5 and adapted to selectively connect the two.

The shaft 5, having axis A, protrudes axially from a body 7 of the pump 1 with its end portion 8, on which the pulley 3 is rotatably supported via a bearing 9. The pulley 3 comprises integrally an internal cylindrical wall 10 mounted on the bearing 9, a radial flange 11 extending from one end of the wall 10 opposite to the pump 2 and a peripheral crown 12 externally coaxial with the portion 10 and preferably provided with a plurality of grooves 13 for cooperating with the belt 4, preferably of the poly-V type.

The wall 10, the flange 11 and the crown 12 define an annular cavity 17 open towards the body 7 of the pump 2, in which the coupling 6 is housed, which therefore is contained within the space requirement of the pulley 3.

The coupling 6 comprises an electromagnet 18 mounted in fixed position on the body 7 of the pump 2 and in turn comprising an annular support 19 rigidly fastened to the body 7 and defining a C-shaped annular seat 20 open towards the flange 11 of the pulley, and a coil 21 housed inside the seat 20.

The coil 21 is adapted to be connected to a control unit (not shown), from which it is adapted to receive electrical energizing signals.

The electromagnet 18 also comprises a armature 24, consisting of a soft steel ring facing the coil 21 and mounted on a first face 25 of an annular support 26 housed in the cavity 17 between the support 19 and the flange 11 of the pulley 3. The support 26 is in turn fastened to an external peripheral portion of a diaphragm spring 27 consisting of a steel plate disk preferably equipped with a plurality of radial slots 23, which is mounted on a supporting ring 28 force-fitted on the shaft 5. On a second axially opposite face 29 of the annular support 26, there is fastened a friction ring 30, which is adapted to cooperate with the flange 11 under an elastic load generated by the diaphragm spring 27.

The operation of the device 1 is as follows.

In the absence of excitation signals from the coil 21, the pulley 3 is rotationally connected to the shaft 5 via the friction coupling between the flange 11 and the friction ring 30 which is drivingly connected to the shaft 5 via the annular support 26, the diaphragm spring 27 and the supporting ring 28.

If the coil 21 is energized, the armature 24 is attracted by the coil 21, thereby detaching the friction ring 30 from the flange 11 of the pulley 3, and comes into contact with the support 19, against the action of the diaphragm spring 27 which biases it towards the flange 11.

In use, the coil 21 is energized at cold start-ups, so that the pump 2 is not rotationally driven. When the engine has reached a warmed-up condition, the coil 21 is de-energized and the diaphragm spring 27 returns the friction ring 30 against the flange 11 of the pulley, thereby reconnecting the pulley 3 to the shaft 5.

Figure 2:
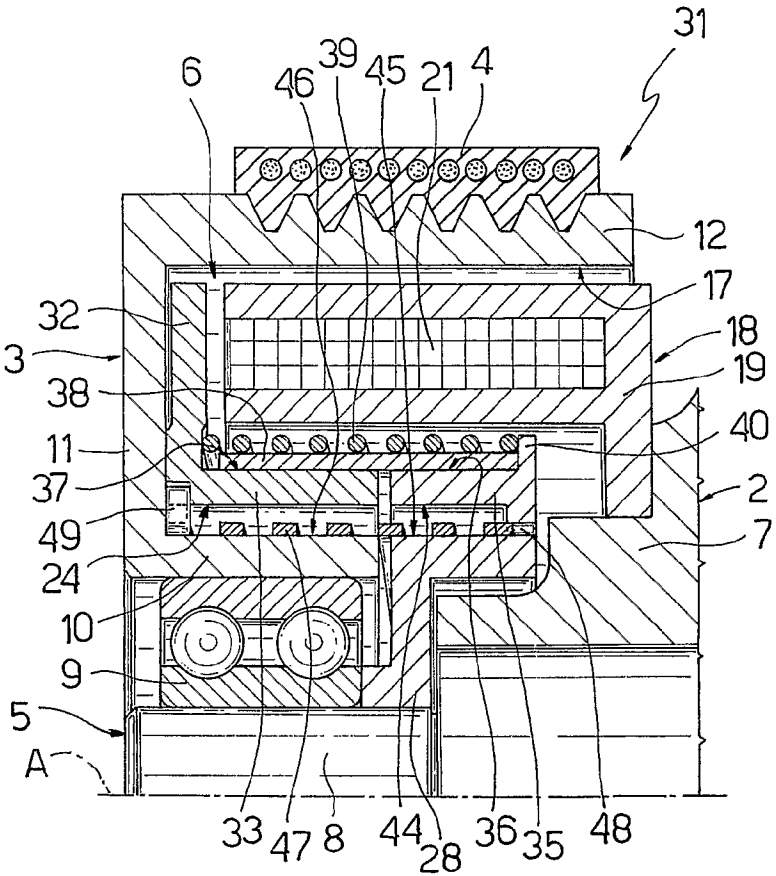
FIG. 2 is a partial axial section of a second embodiment of the invention.

FIG. 2 shows a device 31 according to a different embodiment of the present invention. The device 31 is described below as far as it differs from device 1 previously described, using equal numerals to refer to parts that are equal or corresponding to those previously described.

In the device 31, the armature 24 of the electromagnet 18 presents an L-section, being formed by a flat annular wall 32 and by a cylindrical axial wall 33 protruding from an internal edge of the flat annular wall 32 towards the pump body.

The coupling 6 moreover comprises a supporting ring 28 force-fitted on the shaft 5 in a position comprised between the body 7 of the pump 2 and the bearing 9. The supporting ring 28 comprises an axial cylindrical wall 35, which presents an external surface 36 aligned with the external surface 37 of the axial cylindrical wall 33 of the armature 24.

On the aforesaid surfaces 36, 37 there is fitted a bushing 38, conveniently made of low friction coefficient fluorinated plastic material, around which a helical spring 39 is arranged and axially compressed between a radial shoulder 40 external to the supporting ring 28 and the annular flat wall 32 of the armature 24, so that the armature 24 is held in contact with the flange 11 of the pulley 3 in the absence of excitation of the coil 21.

The cylindrical axial wall 35 of the supporting ring 28 presents a frontal annular seat 44 open towards the armature 24; this seat has an internal surface 45 aligned with an external surface 46 of the internal wall 10 of the pulley 3.

The coupling 6 finally comprises a helical band spring 47, wound on the aforesaid surfaces 45 and 46. The band forming the spring has a rectangular section elongated in the axial direction.

The band spring 47 has ends 48, 49 fastened to the supporting ring 28 and the armature 24 respectively, so as to be subjected to a traction load by the spring 39. The band spring 47 is dimensioned so as to exert, under the aforesaid traction load, a radial compression force on the surfaces 45, 46 and therefore to transmit the motion by friction between the pulley 3 and the supporting ring 28 when the coil 21 is not energized and the armature 24 is held by the spring 39 against the flange of the pulley 3.

When the coil 21 is energized, the armature 24 is attracted and the band spring 47 tension is released; therefore, the diameter of its turns tends to increase and release the pulley 3, which becomes idle with respect to the shaft 5.

When the coil is de-energized, the armature 24 is pushed against the flange 11 of the pulley 3 and receives from this a friction torque which tends to rotatably drive, with the armature itself, the end 49 of the band spring 47 and therefore to increasingly tighten the band spring 47 on the surfaces 45, 46.

Figure 3:
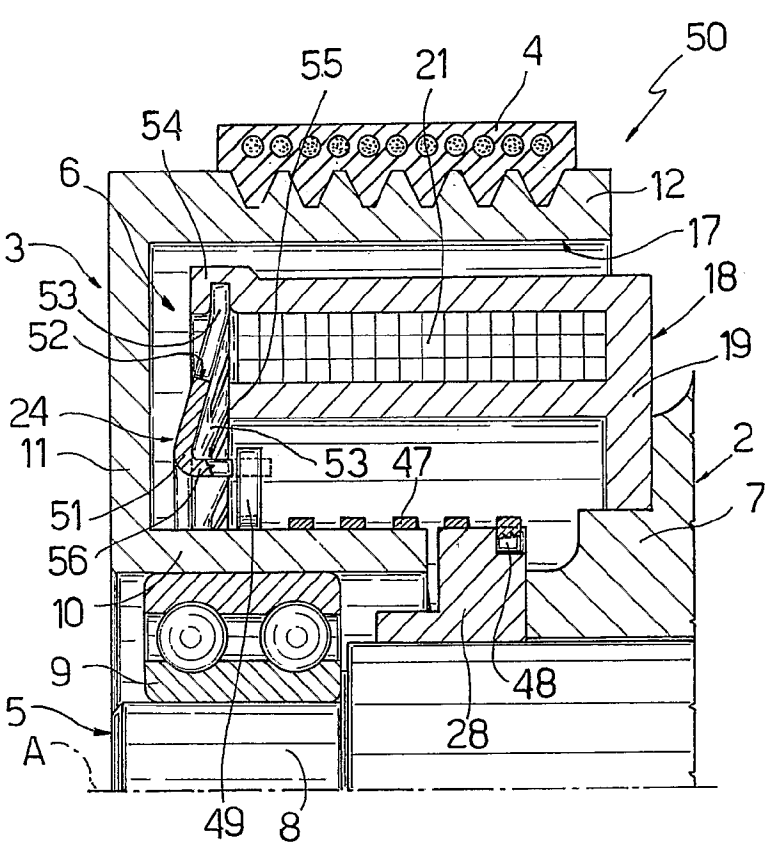
FIG. 3 is a partial axial section of a third embodiment of the invention.

FIG. 3 illustrates a further embodiment of an actuating device according to the present invention, indicated as a whole by 50.

Also in device 50, the releasable connection of the pulley 3 to the shaft 5 is obtained by means of a band spring 47 wound partly on the inner wall 10 of the pulley and partly on the supporting ring 28, where the end 48 of the band spring 47 is fastened. The spring 47 is mounted with radial preload so as to maintain the pulley 3 normally connected with the support 28 and therefore with the shaft 5. In this case, the end 49 of the spring 47 is radially bent outwardly, as will be better explained below.

The armature of the electromagnet 18 consists of an essentially conical annular diaphragm spring 24, having a circumferentially continue inner portion 51, and an outer portion interrupted by a plurality of radial slots 52, so as to define a plurality of elastic radial arms 53 each of which protrudes from the inner portion 51. The radial arms 53 are fastened at their own ends to an outer frontal edge 54 of the support 19 of the coil 21, for example by deformation machining (beading) of the latter. In undeformed conditions, the arms 53 are spaced with respect to an inner front edge 55 of the support 19 of the coil 21.

An appendix 56 extends axially from the inner portion 51 of the spring 24 towards the band spring 47. The appendix 56 does not interfere with the end 49 of the band spring 47 when the spring 24 is undeformed but is adapted to intercept the end 49 when the spring 24 is attracted by the coil and the arms 53 are elastically deformed, thus allowing the appendix 56 to reach an advanced position illustrated by a dotted line in FIG. 3.

The operation of the device 50 is as follows.

When the coil 21 is not energized, the spring 47 is elastically tightened around the inner wall 10 of the pulley 3 and connects it to the support 28. Therefore, the pulley 3 turns with the shaft 5. The same spring 47 rotates rigidly with the pulley 3, the support 28 and the shaft 5.

When the coil 21 is energized, the spring 24 is attracted and the appendix 56 moves to the advanced position. Therefore, it blocks the rotation of the end 49 of the spring 47, torsionally loading the spring. Given the direction of rotation of the pulley 3, the direction of winding of the band spring 47 is such that the aforesaid torsion load on the spring 47 (in the band compression-stressing direction) tends to expand the turns and release the wall 10 of the pulley 3. Therefore, the pulley 3 can idly turn on the bearing 9 but the torque is not transmitted to the shaft 5 and the pump is therefore deactivated.

According to a fourth embodiment of the present invention (FIGS. 4 and 5), an actuating device 60 is provided including a disc-shaped armature 61 axially slidable on, but rotationally coupled to, a hub 62 that is force-fitted on the pump shaft 5. Preferably, the armature 61 is coupled to the hub 62 by means of a spline coupling 63 as shown in FIG. 5.

The armature 61 is axially interposed between the pulley flange 11 and the electromagnet 18, and has a friction lining 64 on its side facing the wall 11. A Belleville washer 65, resting on a shoulder 66 of the hub 62, biases the armature 61 towards the pulley flange 11.

In use, washer 65 holds armature 61 against flange 11 allowing power transmission and, when water pump is not necessary, coil 21 is energized and armature 60 separates from flange 11 and disengages shaft 5 from pulley 3.

Figure 6:
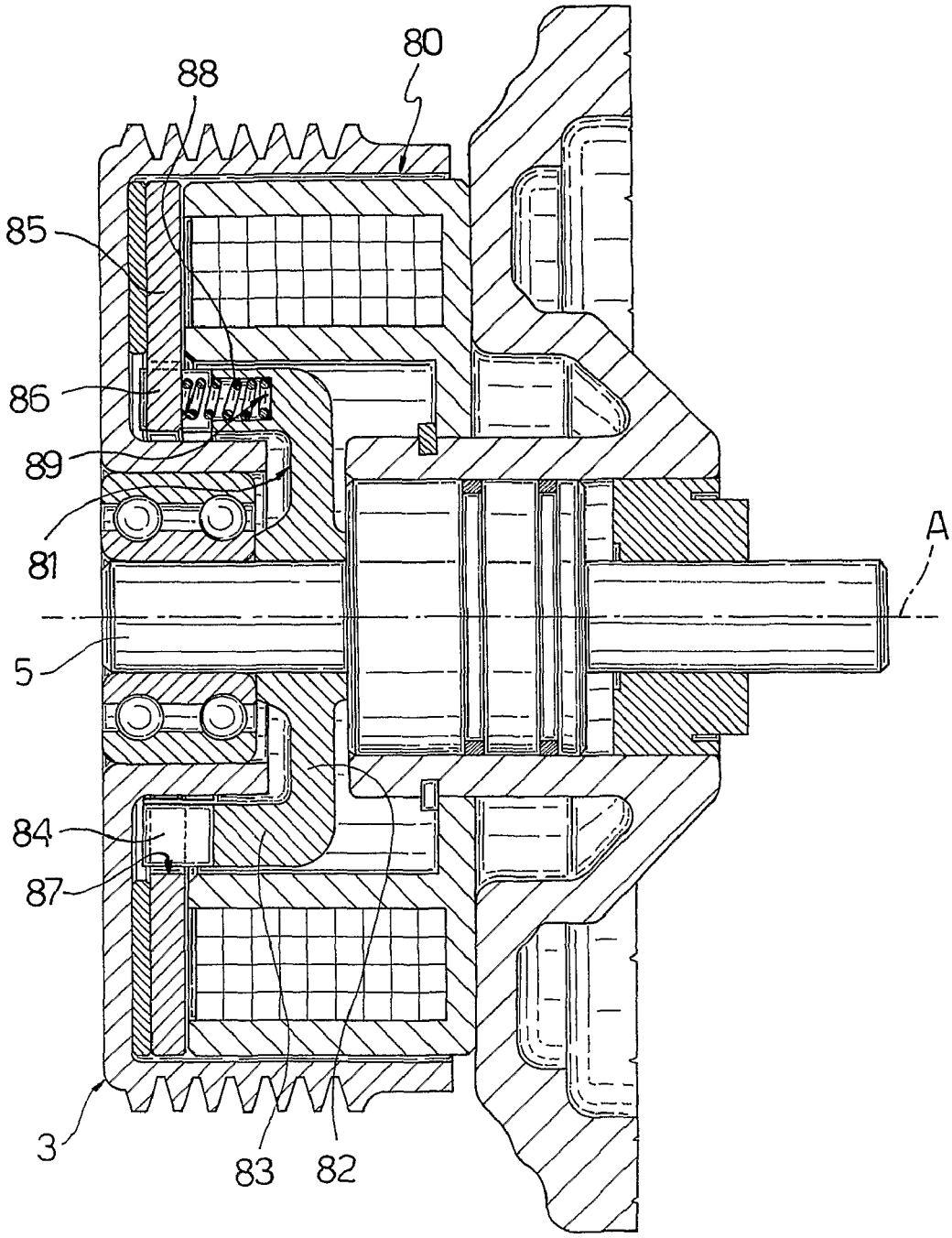
FIG. 6 is a partial axial section on two different axial planes of a fifth embodiment of the invention.

According to a further embodiment of the present invention (FIGS. 6 to 8), an actuating device 80 is provided which comprises a cup shaped hub 81 having a base wall 82 force-fitted to the shaft 5 and a cylindrical wall 83 extending axially from base wall 82 and provided with and frontal teeth 84.

Figure 7:
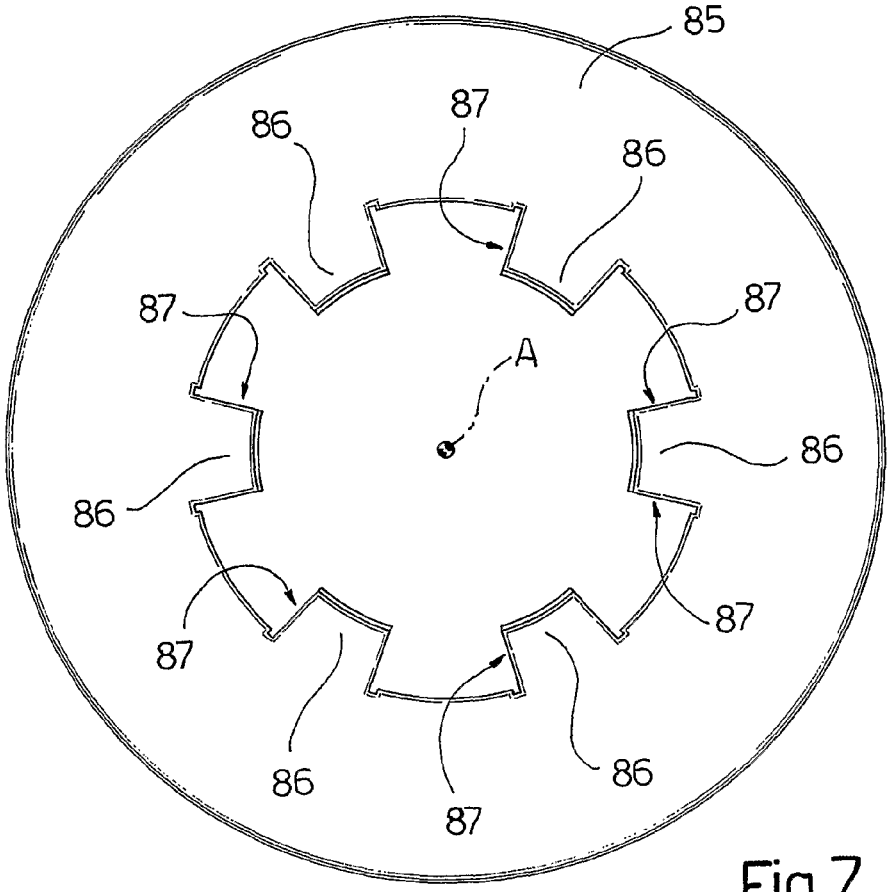
FIG. 7 and FIG. 8 are front views of respective details of FIG. 6.
Figure 8:
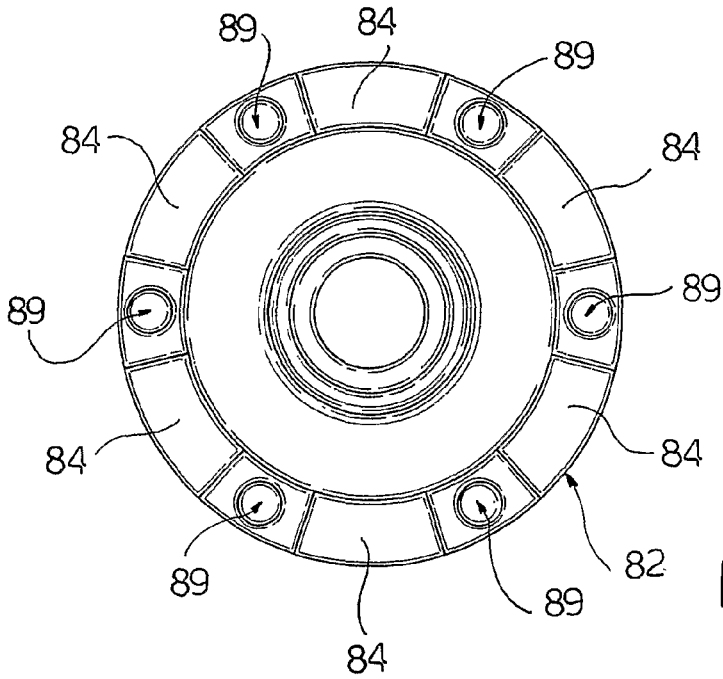

Furthermore, device 80 comprises an annular armature 85 having a splined inner edge formed by radial projections 86 spaced by cavities 87 (FIG. 7). Each cavity 87 is slidably engaged by a corresponding front tooth 84 and armature 85 is biased against flange 11 by a plurality of coil springs 88 partially housed inside respective blind holes 89 of hub 81 and cooperating with the respective radial projection 86.

In particular, each blind hole 89 is parallel to axis A, is located on cylindrical wall 83 between two adjacent frontal teeth 84 and defines a radial constraint for the respective spring 88 against centrifugal force.

Figure 4:
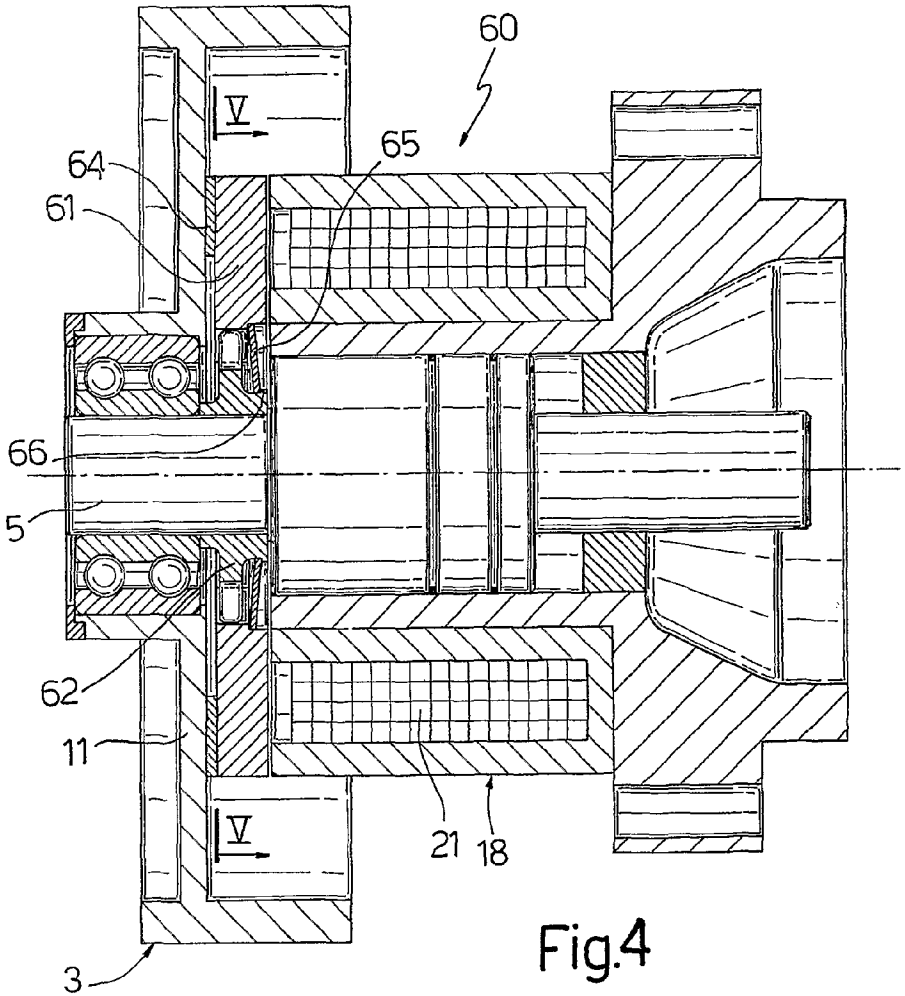
FIG. 4 is a partial axial section of a fourth embodiment of the invention.
Figure 5:
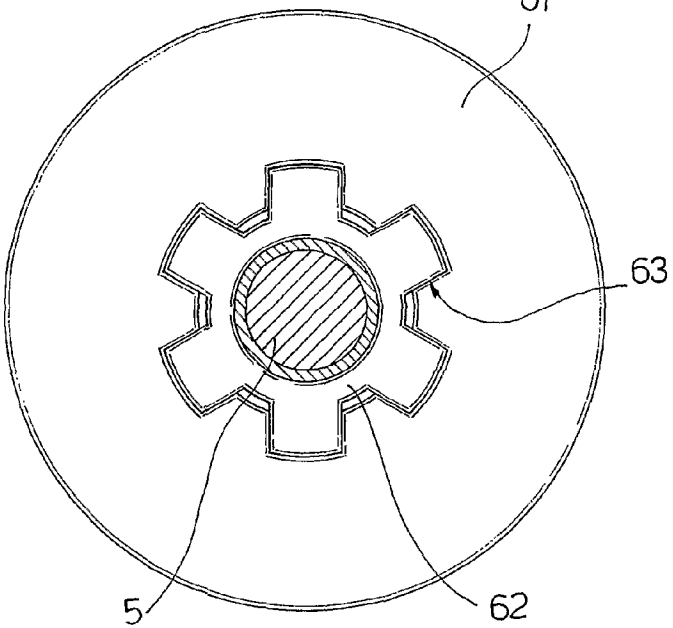
FIG. 5 is a front view of a detail of FIG. 4.

Operation is similar to that of device 60 of FIGS. 4 and 5. In use, springs 88 bias armature 85 against flange 11 allowing power transmission and, when water pump is not necessary, coil 21 is energized and armature 85 separates from flange 11 and disengages shaft 5 from pulley 3.

From a review of the devices 1, 31, 50, 60, 80 made according to the present invention, the advantages that it allows to achieve are evident.

In particular, the selective operation of the pump 2 is made possible by means of a very simple, compact and cost-effective device which guarantees, in the event of an electrical failure, that pump 2 is though driven by the pulley 3 and therefore guarantees the engine cooling.

The invention claimed is:

1. An actuating device for a recirculation pump of a cooling circuit of an internal combustion engine comprising a driving member having a rotation axis (A) and adapted to be rotatably driven by the internal combustion engine, a driven member for driving said pump and an electromagnetically controlled coupling interposed between the driving member and the driven member, in which the coupling comprises an electromagnet, a coupling mechanism controlled by said electromagnet and movable between an engagement position in which said driving member is connected to said driven member and a disengagement position, and an elastic member maintaining said coupling mechanism in said engagement position when said electromagnet is not energized.

2. The device according to claim 1, wherein the electromagnet comprises a coil and a mobile armature.

3. The device according to claim 2, wherein the elastic member acts on said mobile armature in opposition with said coil.

4. The device according to claim 2, wherein the armature is rotationally rigidly connected to one of said driving member or driven member, said coupling member comprising a friction element rigidly connected to said armature and adapted to cooperate with the other of said driving member or driven member.

5. The device according to claim 4, wherein said armature is rotationally rigidly connected to said driven member via said elastic member.

6. The device according to claim 5, wherein said friction element is a friction disk carried by said armature and adapted to cooperate frontally with said driving member.

7. The device according to claim 6, wherein said elastic member comprises a diaphragm spring connecting the armature to a supporting element rigidly connected to said driven member.

8. device according to claim 1, wherein said coupling member comprises a band spring wound partially on a first element rigid with the driving member and partially on a second element rigid with said driven member, said band spring exerting an elastic tightening action such as to rotationally constrain said first and second element together.

9. The device according to claim 8, wherein said elastic member comprises a second spring coaxial with said band spring and interposed between said armature and said second element, said band spring having one end fastened to said second element and one end fastened to said armature, so that the action of said coil on said armature produces a shift such as to deform the band spring and disengage it from said first element.

10. The device according to claim 8, wherein said band spring has an end fastened to said second element and a second free end; said armature being movable between a position of disengagement of said second end of the band spring and a position of engagement with said second end of the band spring, the engagement between said armature and said second end of the band spring determining a torsional load on said band spring such as to disengage it from said first element.

11. The device according to claim 10, wherein said armature is a diaphragm spring having an outer portion fastened to a support of said electromagnet and an inner portion forming an appendix adapted to cooperate with said second end of said band spring.

12. The device according to claim 6, further comprising a hub element is rigidly connected to said driven member, and said armature is rotationally fixed to, but axiall slidable on, said hub element.

13. The device according to claim 12, wherein said elastic member is carried by said hub element.

14. The device according to claim 13, wherein said armature is coupled to said hub element by a spline.

15. The device according to claim 12, wherein said hub element has front teeth, said armature having an internal spline defined by a plurality of radial projections spaced by cavities that are slidingly engaged by said front teeth of said hub element.

16. The device according to claim 15, wherein said elastic member include a plurality of springs compressed between said hub element and said armature.

17. The device according to claim 16, wherein said support element is cup shaped and has a cylindrical wall provided with said front teeth, said springs being located each between two adjacent teeth of said hub element and cooperating with a respective radial projection of said armature.

18. The device according to claim 17, wherein said springs are partially housed within respective blind holes of said cylindrical wall of said hub element.

19. The device according to claim 1, wherein said driving member is a pulley and that said coupling mechanism is contained in a cavity adjacent said pulley.

20. The device according to claim 1, wherein said driven member is an input shaft of said pump.

* * * * *